US005495676A

United States Patent [19]

Chesnut et al.

[11] Patent Number: 5,495,676

[45] Date of Patent: Mar. 5, 1996

[54] LENS CAP ASSEMBLY AND REMOVAL METHOD

[75] Inventors: M. Gaines Chesnut, Grand Junction; Dennis D. Sweet, Loma; Marc A. Ulasik, Clifton; James B. Watson, Grand Junction, all of Colo.

[73] Assignee: Blount, Inc., Montgomery, Ala.

[21] Appl. No.: 233,116

[22] Filed: Apr. 25, 1994

[51] Int. Cl.[6] ..... F41G 1/04; F41G 1/01

[52] U.S. Cl. ..... 33/244; 33/233; 359/511

[58] Field of Search ..... 33/233, 242, 244, 33/245, 246, 266, 243; 359/399, 507, 511, 512, 600; 42/101

[56] References Cited

U.S. PATENT DOCUMENTS

| | | | |
|---|---|---|---|
| 1,683,106 | 9/1928 | Schrank . | |
| 2,488,188 | 11/1949 | Halvorson . | |
| 2,599,689 | 6/1952 | Brelsford | 33/244 |
| 2,696,672 | 12/1954 | Durfee . | |
| 2,849,795 | 9/1958 | Vissing . | |
| 3,131,477 | 5/1964 | Thomas | 359/511 |
| 3,426,433 | 2/1969 | Anderson . | |
| 3,496,642 | 2/1970 | Pfahler | 33/244 |
| 3,746,423 | 7/1973 | Mills | 33/244 |
| 3,831,285 | 8/1974 | Vissing | 33/244 |
| 3,942,864 | 3/1976 | Numbers . | |
| 3,983,634 | 10/1976 | Erickson | 33/244 |
| 4,327,960 | 5/1982 | Gould . | |
| 4,392,723 | 7/1983 | Gehmann | 33/243 |
| 4,456,348 | 6/1984 | Schulz et al. | 351/212 |
| 4,515,082 | 5/1985 | Pizzurro | 102/293 |
| 4,777,730 | 10/1988 | Huggins | 33/245 |
| 4,899,450 | 2/1990 | Huggins | 33/245 |
| 5,020,892 | 6/1991 | Glover et al. | 33/245 |
| 5,150,528 | 9/1992 | Shire | 33/244 |
| 5,353,134 | 10/1994 | Michel et al. | 33/241 |

OTHER PUBLICATIONS

Butler Creek Corporation, Belgrade, MT, "Innovative Products for the Shooting Sports" 1994 Catalog. (no month).

Quake Industries 1994 Product Catalog. (no month).

*Primary Examiner*—Andres Kashnikow
*Assistant Examiner*—G. Bradley Bennett
*Attorney, Agent, or Firm*—Sheridan, Ross & McIntosh

[57] ABSTRACT

A lens apparatus is disclosed for use with a firearm scope. The lens apparatus includes first and second polarized lenses that move relative to each other. When differently colored lens materials are used and when moved relative to each other, the color seen through the two polarized lenses changes. In affixing the first and second polarized lenses to the firearm scope, first and second connection assemblies are utilized. The two connection assemblies have first and second latch release members, respectively. The two latch release members are located on the right and left sides of a scope when a user is in the normal shooting position. Upon actuation of the latch release member, pivotal movement of the polarized lenses, relative to the firearm scope lenses occurs. Each of the two connection assemblies includes a sleeve member and a cap lid. The sleeve member is flexible to surround portions of the firearm scope and is made of a material different from the cap lid material. Each of the two connection assemblies also have a spring positioned in a lid hinge member. Each of the springs biases a polarized lens away from a firearm scope lens.

4 Claims, 7 Drawing Sheets

LENS CAP ASSEMBLY AND REMOVAL METHOD

FIELD OF THE INVENTION

The present invention relates to a protective and visual enhancement cover for optical systems, such as rifle scopes, binoculars, spotting scopes, telescopes and the like, useful in processing light coming through the device and in protecting the lenses of such devices from damage and from collecting obscuring foreign matter.

BACKGROUND OF THE INVENTION

Many types of optical system covers which are designed to protect the ocular and/or objective ends of the optical system have previously been provided. In the case of a rifle scope, the lens nearest the shooter's eye is called the ocular or eye piece lens, while the one toward the barrel end of the scope is called the objective lens. The simplest rifle scope cover is rubber-like "plates" which are affixed over the lenses of an optical system, sometimes with rubber bands. An improved type of cover is simply a resilient cup-shaped cover which is stretched over one end of an optical system, such as a rifle scope, to protect the lens from damage when the optical device is not actually in use. Such a cover is disclosed in U.S. Pat. No. 5,150,528 to Shire, issued on Sep. 29, 1992.

A second type of cover relates to a flip-up cover that fits over the lens portion of an optical system. This type of system either moves away from the optical lens upon use of that system or is manufactured out of a material that allows the user to see through the cover while the optical device is in use. Representative covers of these types are disclosed in U.S. Pat. No. 2,488,188 to Halvorson, issued on Nov. 15, 1949; U.S. Pat. No. 2,849,795 to Vissing, issued on Sep. 2, 1958; U.S. Pat. No. 3,831,285 to Vissing, issued on Aug. 27, 1974; and in the Blizzard™ scope cover manufactured by Butler Creek Corporation®.

The present invention specifically relates to a rotate-up type of cover. There are several distinct problems with these type of prior art devices. First, many require the user to remove their hands from the shooting or functional position and/or remove their eyes from a line of sight, possibly causing loss of target sighting. Second, many of these devices are made of an opaque material, allowing use of the optical system to which they are attached only upon removal or actuation of the covers, severely limiting rapid deployment or use of the system. The Halvorson patent discloses this type of cover.

While generally more useful, known see-through lens covers still have significant shortcomings. These prior art covers do not allow a user to vary the intensity or color of light emanating through the optical system to which the cover is attached. Such advantages would be of benefit to optical system users, especially during outdoor use. Indeed, in extreme environmental conditions, it is often times difficult for an optical system user to focus upon a desired object if either too much or not enough light is coming through that system or mirage or glare effects exist.

Similarly, prior art devices do not disclose any mechanism for eliminating or reducing environmentally created glare or mirage. Both of these natural phenomena tend to impair an optical system user's ability to focus on desired objects. Further, many of the cover release systems utilized by prior art devices are cumbersome and often times difficult to engage or disengage quickly, nor can they be released or actuated without the user leaving the target sighting or shooting position. Some of the prior art systems are also noisy in operation, an undesirable attribute, especially in wildlife viewing settings.

SUMMARY OF THE INVENTION

An object of the present invention is to provide a lens cover comprised of, among other things, see-through adjustable polarized lenses, allowing a user to vary the amount and density of light coming through the lenses.

Another object of the present invention is to provide polarized lenses that can change the color of light coming through an optical system upon adjustment of the lens orientation from one to another.

A further object of the present invention is to reduce or eliminate environmental glare and mirage.

Yet another object of the invention is to provide an easy-to-operate and quiet lens cap release system that is integrally formed to the cover and provides a cover assembly that will remain affixed to the subject optical device in all types of environmental conditions.

It is still another object of the present invention to allow the covers to be operated by a user without leaving a normally desired optical system use position. For instance, where the lens caps are used on a rifle scope, the caps can be operated without leaving the shooting position or, if for use on a spotting scope, binocular or other type of optical system, without losing sight of the target object while attempting to activate the lid portion of the covers.

In accordance with these and other objectives of the present invention, an apparatus for use in viewing is provided and has particular utility, among other applications, with a firearm scope. The apparatus includes first and second lens cap assemblies or lid assemblies. The first lens cap assembly is connected adjacent to a first scope lens and the second lens cap assembly is connected adjacent to a second scope lens.

The first and second lid assemblies are substantially similar, thus reducing the number of units needed to be stocked by a dealer, as the front and rear lens cap assemblies are interchangeable. The first lid assembly preferably includes a first polarized lens for use in varying the intensity of light and potentially colors seen through the first polarized lens. It can be appreciated that if light intensity and color variations are not desired, the lens can be made of any suitable material, such as glass or plastic. Where polarized lenses are used, the first polarized lens may be colored and the second polarized lens may also be colored. If the lenses are colored, the colors of the first and second polarized lenses may be the same or they may be different. The two polarized lenses are also relatively moveable or rotatable to facilitate color variations, if the first and second lenses are differently colored, seen through the first and second polarized lenses and to vary the intensity of light received through the first and second polarized lenses.

In one embodiment, one of the first and second polarized lenses have a yellowish and the other has a grayish color or tint in which relative movement therebetween results in change from a yellowish color to a grayish color. It can also be appreciated that multiple differently colored lenses can be used in a single lens cap, facilitating color and light density changes through use of a single lens cap. Equally obvious, a single lens cap with a polarized or non-polarized lens can be used singularly on an optical device to protect only one end of that device. It should be understood that other applications of the relatively moveable first and second polarized lenses are available including, but not limited to, incorporating such polarized lenses as part of sunglasses or ski or cycle goggles.

With respect to the relative movement, each of the lid assemblies includes a lens ring for receiving one of the polarized lenses. The lens ring is rotatable to cause the polarized lens to rotate. In the preferred embodiment, when used with a firearm scope, each of the two lens rings is rotatable; however, in achieving a color change, the two lens rings are moved relative to each other, facilitating variable relative orientation of one polarized lens with respect to the polarizing orientation of the other lens. For example, one of the two lens rings is maintained in the same position while the other lens ring is rotated.

Each of the two lid assemblies includes a cap lid that overlies a scope lens. A latch receiving space is provided with each of the two cap lids. In order to connect the lid assemblies to the firearm scope, first and second connection assemblies are provided, with each of these being substantially similar to each other. Both of the first and second connection assemblies have lid hinge members for use in providing, in one embodiment, pivotal movement of the cap lid. A biasing spring, preferably made of metal, is provided in each of the lid hinge members. The spring biases the cap lid, including the polarized lens, in a direction away from the firearm scope lens.

Each of the first and second connection assemblies includes a mounting sleeve that is preferably made of a flexible material that is disposed about outer portions of the firearm scope. A ring member is disposed outwardly adjacent to the sleeve at both the ocular and objective ends of the firearm scope. A latch release member is also part of each of the two connection assemblies. Each latch release member cooperates with one of the latch release member spaces to hold a lid assembly in position over the firearm scope lens. The latch release member is activated to cause disengagement relative to the latch space so that the lid assembly is pivotally moved and the lid assembly is uncovered relative to the firearm scope lens.

In the preferred embodiment and upon installation of the device to a rifle scope or other tubular optical device, the first and second connection assemblies differ in the location of their latch release members. With specific reference to a rifle scope affixed to a rifle, when the rifle is held in a normal shooting position by a user, the latch release members of the first and second connection assemblies can be said to be on different sides of the weapon. Specifically, the first latch release member of the first connection assembly is disposed on the right hand side of the scope, relative to the user. Conversely, the latch release member of the second connection assembly is found on the left hand side of the scope relative to the user. As will be appreciated, due to this unique configuration of latch release members, a shooter is able to activate the first and second latch release members while still making contact with the trigger and stock of the firearm, in a normal shooting position, to which the firearm scope is attached.

In using the apparatus of the present invention with a firearm scope, the first and second lid assemblies are used to cover the first, eye piece or ocular, and second, objective, firearm scope lenses. When using the polarized lenses to vary the color that is seen by the user of the firearm scope, one lens ring may be rotated relative to the other until a desired color or light density is achieved. When the user is preparing to shoot using the firearm scope, the digits of one of the user's hands is positioned adjacent the first latch release member, while another digit of the same hand is able to contact the trigger of the firearm. At the same time, a digit of the other hand of the user is able to engage the second latch release member. When desirable, the first and second latch release members can be activated virtually simultaneously, or as the user desires, to uncover the firearm scope lenses and the firearm trigger can also be activated close in time to the lens uncovering steps.

Other objects and advantages of the invention will become more apparent upon review of the disclosed drawings and description of the preferred embodiment.

DETAILED DESCRIPTION

Figure 1:
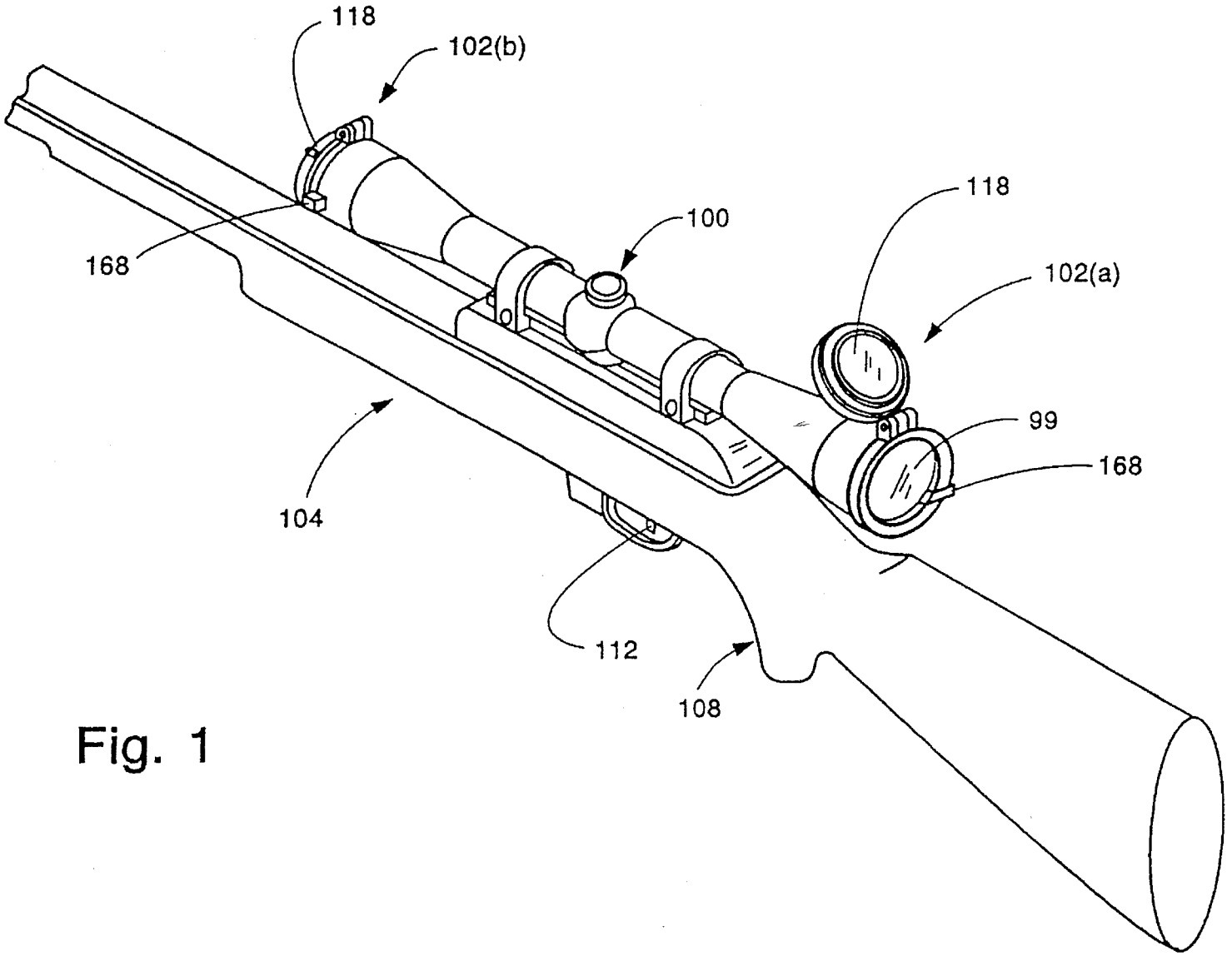
FIG. 1 is a perspective view of a forward and rear cover, attached to a scope that has been mounted on top of a rifle.

The present invention is useful in the protection of the ocular and/or objective ends of optical systems, such as rifle scopes, binoculars, spotting scopes, telescopes and the like. In a preferred embodiment, as can be seen in FIG. 1, the lenses 99 of a rifle scope 100 are protected from damage and from collecting obscuring foreign matter by use of the inventive lens cap assembly 102. As can be seen by reference to FIGS. 1–3, a first lens cap assembly 102*a* is disposed over the ocular end of the scope 100 while the second lens cap assembly 102*b* is disposed over the objective end of the scope 100. As will be appreciated, the first lens cap assembly 102*a* is shown in the open position, while the second lens cap assembly 102*b* is shown in the closed position.

As can be understood from reviewing the present disclosure, the component parts of first lid assembly 102*a* and second lid assembly 102*b* are identical in placement and construction, except that the positioning of the latch release members 168 and parts relating thereto are reversed upon placing of the first lid assembly 102*a* and second lid assembly 102*b* on opposite ends of the scope 100. Indeed, as shall become obvious, the latch release members 168 positioning is identical, except that the latch release members 168 of the first lid assembly 102*a* is rotated approximately 180° relative to the normal line of sight of the rifle scope 100 when the lens caps 102 are affixed to the scope. Accordingly, the detailed description will only discuss component parts and placement thereof for one lens cap assembly 102, as those parts would be identical for subsequent lens cap assemblies.

As will be appreciated by those skilled in the art, the present invention can be used either in the closed or open position, as the first 102*a* and second 102*b* lens cap assemblies are preferably made of a see-through material. Generally, the lens cap assemblies 102 will remain in the closed position until just prior to firing of the weapon. In fact, most scope manufacturers recommend that no additional lens "plates" be placed outside of the scope lens as optical aberration, such as aim point shifting, can occur.

Once an object has been spotted and sighted in through the present invention, the first lid assembly 118 of the lens cap assemblies 102 can be moved to the open position so that the user of the firearm can view its object directly through the scope lenses 99 without chance of optical aberration. In certain circumstances, such as inclement weather or when low light, glare or mirage are present, a shooter or marksman may desire to leave the first lid assemblies 118 of the lens cap assemblies 102 in their closed position throughout the shooting experience as they will protect the scope from the weather and will help to eliminate the mirage, glare and some low light created optical problems.

Figure 2:
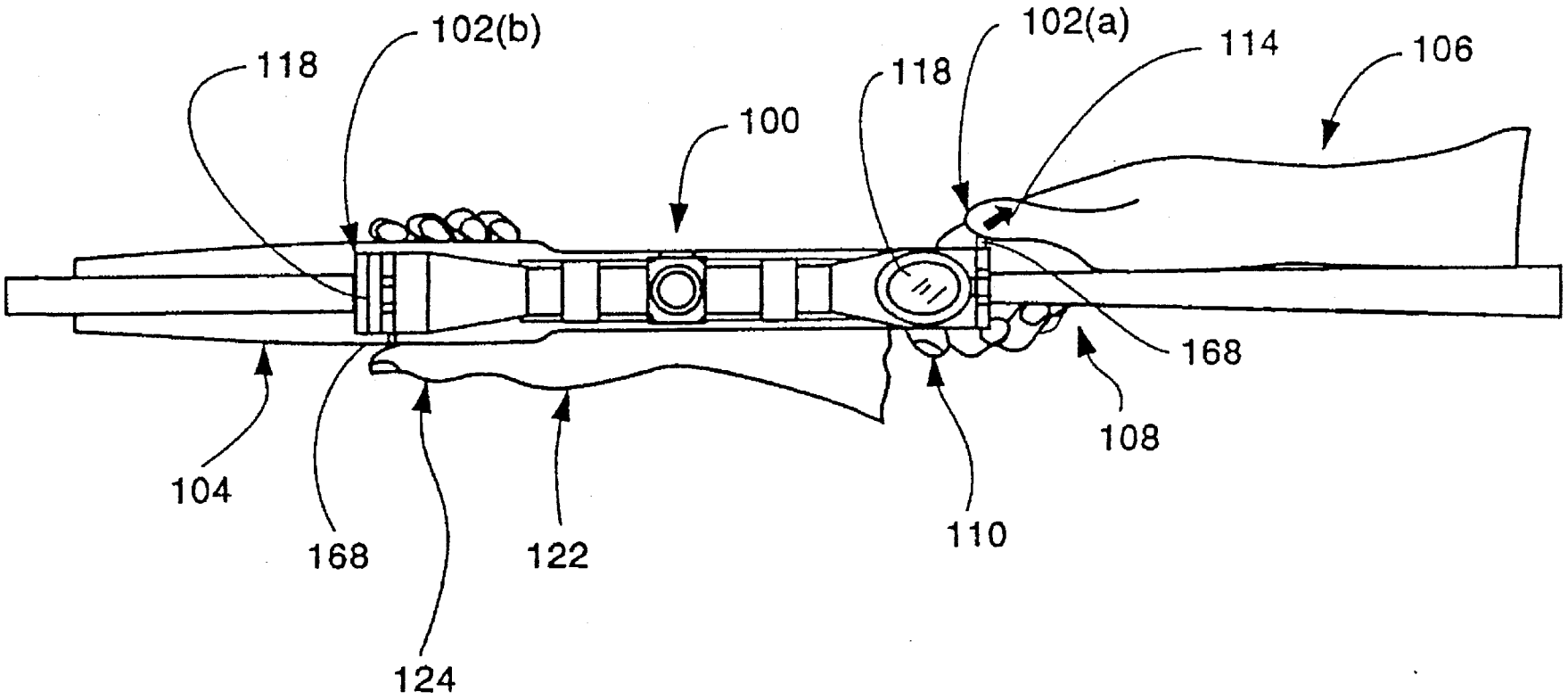
FIG. 2 is a top view of a forward and rear cover, attached to a scope that has been mounted on top of a rifle and showing a right handed shooter about ready to release the caps.

FIG. 2 shows a top view of the first 102*a* and second 102*b* lid assemblies attached to a rifle scope 100, which has itself been attached to a rifle 104. FIG. 2 also shows the hands of a hunter or marksman clutching the rifle 104 in a traditional shooting position. As can be seen, the right hand of the marksman or hunter grabs the rifle stock 108 so that his or her trigger finger 110 can comfortably fit around the rifle trigger 112. In that position, the hunter/marksman's thumb 114 can easily communicate with the latch release member 168 of the first lens cap assembly 102*a*. As explained in greater detail below, when the latch release member 168 is depressed, the first lid assembly 118 pivots about a lid hinge pin 154, allowing unobstructed viewing through the ocular lens 99 of the scope 100, as can be seen in FIG. 1.

Figure 6A:
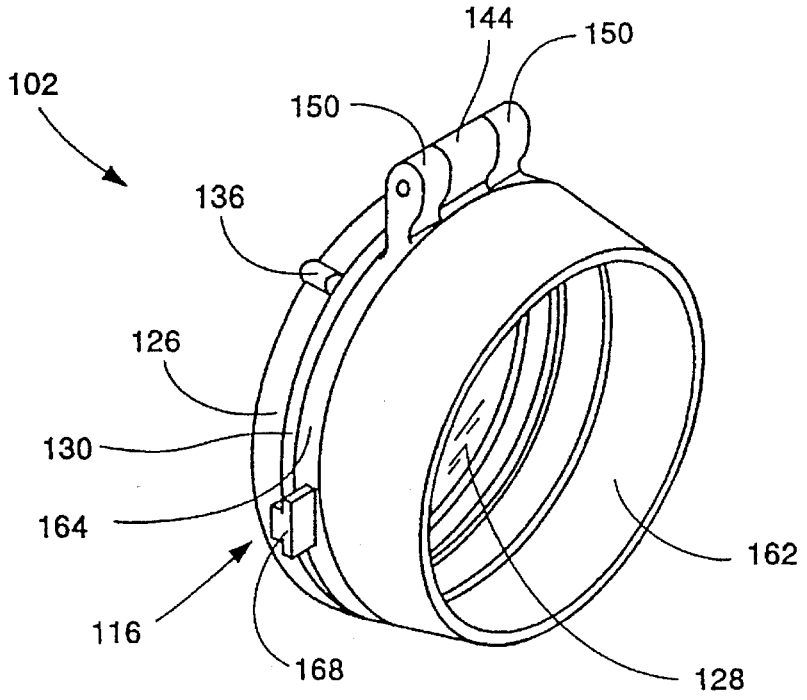
FIG. 6A is a perspective view of the cover assembly, from the rear view, of the cover, lid closed.

Referring back to FIG. 2, the hunter's or marksman's left hand 122 cradles the bottom of the rifle 104 so that his or her left thumb 124 is positioned directly adjacent to the second lens cap assembly 102*b* latch release member 168. As explained above, upon depression of latch release member 168, the first lid assembly 118 pivots about lid hinge pin 154 to allow unobstructed viewing through the lens (not shown) positioned on the objective end of the scope 100. By placing the first 102*a* and second 102*b* lens cap assemblies in positions as indicated in FIG. 2, the marksman or hunter can easily, quickly and virtually simultaneously, if desired, operate the latch release members 168, allowing the first lid assemblies 118 connected to both first 102*a* and second 102*b* lens cap assemblies to move to their open position without leaving the shooting position. A clear view of the first lid assembly 118 in the closed and open positions is disclosed at FIGS. 6A–6B.

While the first 102*a* and second 102*b* lens cap assemblies depicted in FIG. 2 are for a right handed shooter, it should be obvious that positioning of the lens cap assemblies could easily be reversed to accommodate a left handed individual. Similarly, it must be appreciated that, for different types of optical systems, such as binoculars, telescopes and spotting scopes, other latch release member 168 placements can be provided and are contemplated.

Figure 3:
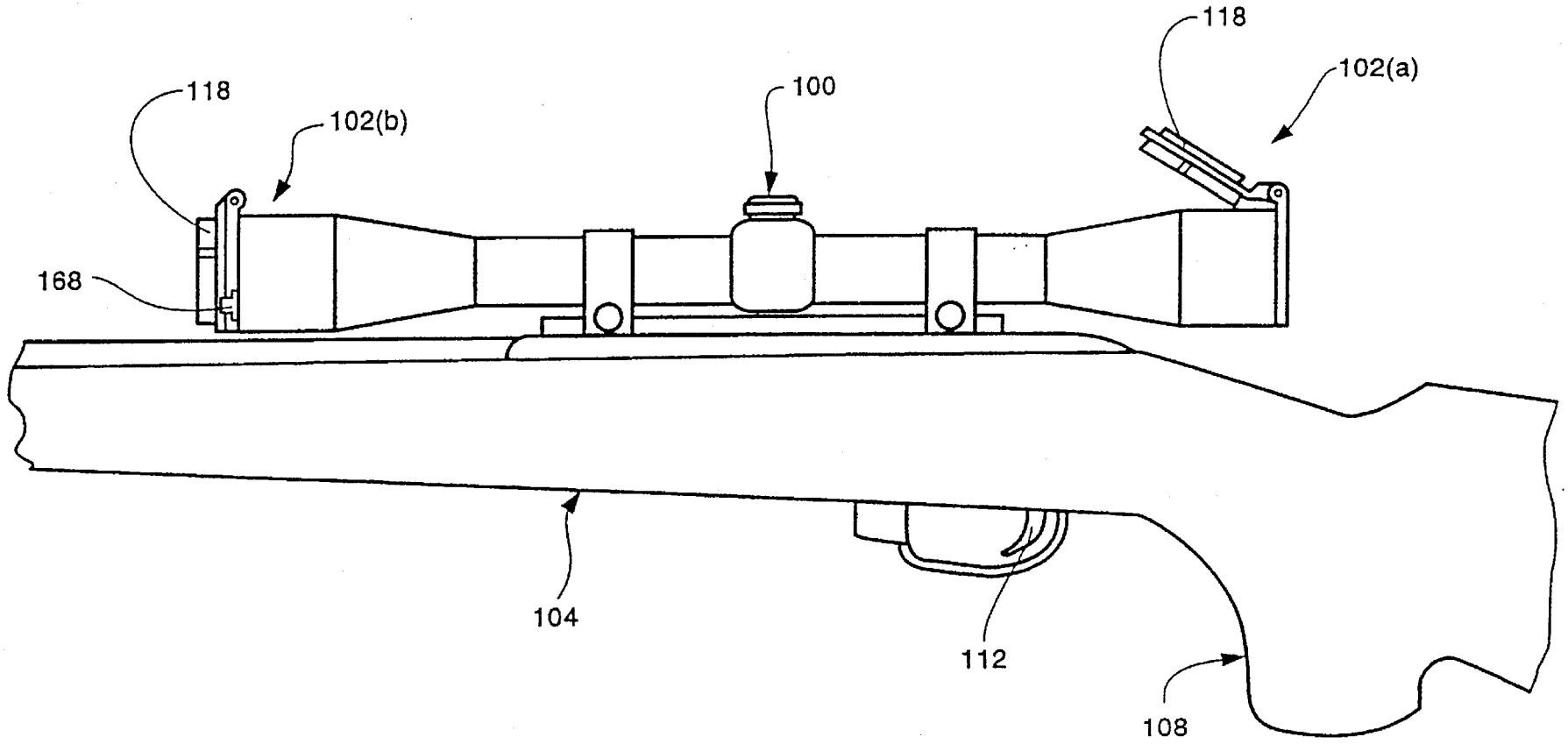
FIG. 3 shows a side view of a forward, i.e. objective lens, and rearward, i.e. eyepiece or ocular lens, scope cover affixed to a scope, with the forward cover in a closed position and the rearward cover in the open position.

FIG. 3 shows a side view of a first 102*a* and second 102*b* lens cap assembly attached to a rifle scope 100, which itself has been attached to the receiver of a rifle 104. A preferred positioning of the latch release member 168 for the second lens cap assembly 102*b* can be viewed and appreciated. The latch release member 168 associated with the first lens cap assembly 102*a* cannot be seen in this view as it is positioned on the side of the scope not shown in the drawing.

Figure 4:
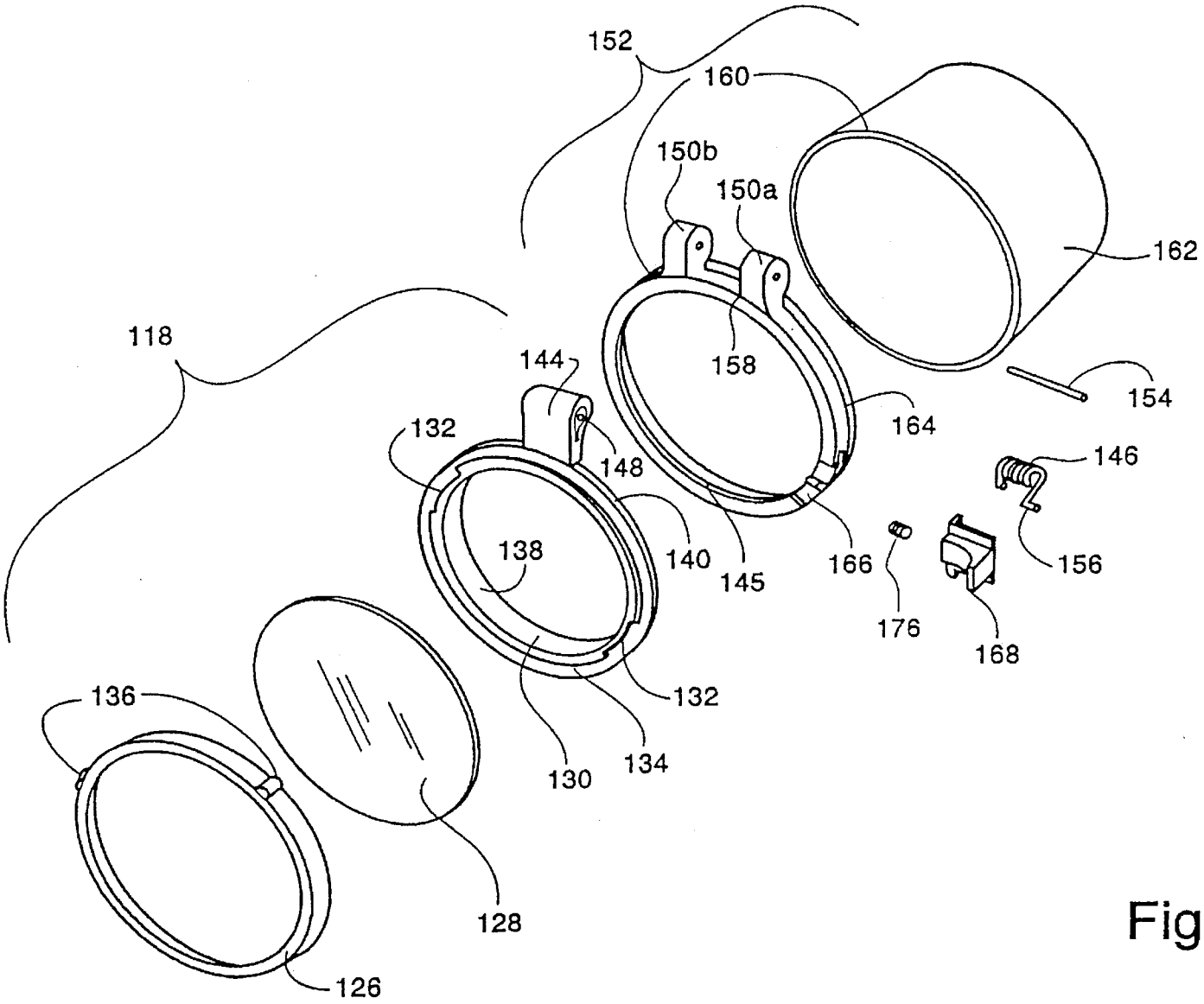
FIG. 4 is an exploded view of the cover assembly.

FIG. 4 shows an exploded view of a complete lens cap assembly 102. The first lid assembly 118 consists of lens ring 126, lens 128 preferably made of a polarized material ("polarized lens"), and cap lid 130. Though the lens 128 can be made of any suitable material, such as glass or plastic, to achieve all of the improvements disclosed in this patent, polarized lens material should preferably be used.

In the preferred embodiment, the lens ring 126 is rotatably attached atop the cap lid 130, sandwiching a polarized lens 128 therebetween. Lens 128 can be attached in a fixed position to lens ring 126, relative to the lens ring 126 by, among other ways, providing a protrusion in the lens 128 that corresponds to a slot in lens ring 126. Such a relative fixation of the lens 128 to the lens ring 126, as discussed below, will facilitate achievement of several inventive aspects of the present invention. For attachment purposes, there are two key members 132 on the outer ring 134 of the cap lid 130. The positioning of the key members 132 correspond with two tabs (not shown) on the inside edge of the lens ring 126. By placing the tabs of the lens ring 126 into the key members 132 on the cap lid 130 and by rotating the lens ring 126, the lens ring 126 becomes secured to cap lid 130 and engages an inner surface of the lens ring 126. Once attached, lens ring 126 is rotatable about cap lid 130 by riding on outer ring 134. In one embodiment of the invention, it is contemplated that a user could easily remove lens ring 126 and lens 128 to allow easy replacement of lens 128. Such replacement could be for any number of reasons, including replacement of a damaged lens, use of differently colored lenses or differently polarized lenses. Indeed, it should be understood that there are other ways to rotatably connect the lens ring 126 to the cap lid 130, including at least press fitting, splining and threadably engaging the two members.

Also, it is obvious to those skilled in the art that the lens ring 126 need not be rotatable, especially if non-polarized materials, such as glass or plastic, are used for the lens 128. Indeed, as explained herein, rotation of the lens ring 126 and thus lens 128 is desirable to achieve light intensity and color variations that occur when differently colored polarized materials are used for the lens 128.

Lens ring 126 may also have an uneven surface periphery which can include a plurality of spaced projections around the surface of the lens ring 126. To accomplish the uneven surface, a plurality of spaced projections 136 can be provided at any number of locations. In the preferred embodiment, the spaced projections 136 are provided around the lens rings 126 at predetermined positions which are located less than 180° about the lens ring 126. Between the two projections 136, ribs (not shown) can be provided to assist in the gripping and rotation of the lens ring 126.

In another embodiment, the spaced projections 136 can generally be useful in providing "stops" to prevent over rotation of the polarized lens 128 relative to the polarizing grooves formed integrally with polarized lens 128 material. Should over rotation occur, various inventive aspects of the present invention, such as visible color change of light coming through the optical system could be lost or diminished. To also help minimize this potential problem, it is contemplated that, along with the tabs, stops can be disposed along the inside edge of the lens ring 126. Such stops would cooperate with similar stops or protrusions in the cap lid 130 to limit or restrict the total amount of rotation of the lens ring 126 relative to the cap lid 130. The amount of allowable lens ring 126 rotation is infinitely variable depending upon the placement of the lens ring 126 and cap lid 130 stops.

The projections 136 also facilitate rotation of the lens ring 126 and thus polarized lens 128 in connection therewith, relative to the cap lid 130. Though two projections 136 with intervening ribs are provided in the preferred embodiment, it should be understood that numerous projections of various forms and sizes could easily be provided and devised by those skilled in the art.

The lens 128 in the preferred embodiment is comprised of polarized Kodacell CAB material. This material can either be manufactured as a clear material or is capable of being dyed to various colors, including, without limitation, yellow, green, rose, gray and blue and numerous variations thereof. Generally, polarized sheet plastic, such as Kodacell CAB, will restrict all light from passing therethrough, except light waves traveling in a predetermined direction or with a predetermined orientation. The characteristics of polarized sheet plastic is thought to be well known and shall not be discussed further in this disclosure.

It has been found that polarized optical lenses will help to minimize or eliminate environmental glare and mirage. It has also been found that, when two differently colored polarized lenses are held, one in front of another, or one adjacent to the objective and one rearward from the ocular scope lenses, and where one lens is rotated relative to the other lens, the color viewed through the lenses will change and the amount and density of light allowed to pass through the lenses will either be increased or decreased, depending upon the rotational relationship of one lens to the other. It is this "cross-polarization" effect, created by use of multiple lenses, independent of the optical system, that allows a user to customize an optical system to their particular personal preference and/or environmental needs.

In the present invention, rotation of lens ring 126 and polarized lens 128 of either the first 102*a* or second 102*b* lens cap assembly, relative to the lens ring 126 and polarized lens 128 of the other lens cap assembly, will vary the amount and density of light ultimately reaching the user's eye at the rear eye relief plane. If differently colored polarized material is used for polarized lenses 128 in the first 102*a* and second 102*b* lens cap assemblies, upon rotation of one polarized lens 128, relative to the other, a change of observed color, as well as light density and intensity, coming through the optical device will occur. For instance, if yellow polarized lens material is used for the polarized lens 128 in the first 102*a* and gray is used in the second 102*b* lens cap assemblies, upon rotation of one polarized lens 128 relative to the other, the color will change from yellow to light gray. If differently colored polarized materials are used for polarized lenses 128, such as green Kodacell CAB material in the first lens cap assembly 102*a* and yellow Kodacell CAB material is used in the second lens cap assembly 102*b*, colors from yellow to green to blue can be experienced by the user.

Indeed, virtually an endless number of color combinations can be created by using differently colored Kodacell CAB material for the polarized lens 128 of the first 102*a* and second 102*b* lens cap assemblies. All such color combinations are contemplated under the present invention. It should also be appreciated that multiple polarized lenses can be attached to a single lens cap assembly 102. If all such lenses are independently rotatable, the effects of color and light density change can be achieved in a single lens cap.

Figure 6B:
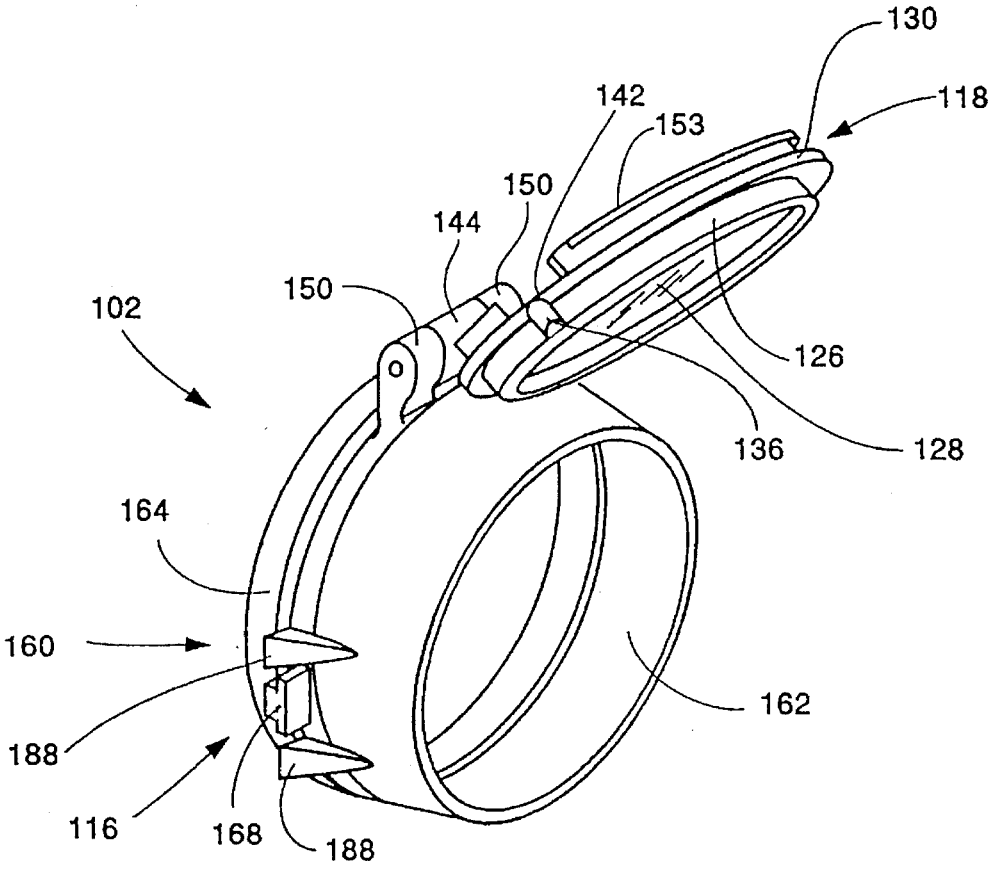
FIG. 6B is a perspective view of the cover assembly, from the rear view, of the cover, lid open.

As can be seen in FIG. 4, the cap lid 130 has an inner annular member 138 and outer annular member 140. A latch receiving space 142, as disclosed in FIG. 6B, is integrally formed between the inner 138 and outer 140 annular members. The latch receiving space 142 is designed to correspond with the latch release member 168. The cap lid 130 also has a friction ring 153 positioned adjacent the latch receiving space 142. Upon closing of the first lid assembly 118, the friction ring 153 frictionally engages the inner lip 145, shown on FIGS. 7A and B, of ring 164 holding the first lid assembly 118 in a closed position. Upon depression of latch release member 168, which contacts the inner surface 143 of the latch receiving space 142, the friction ring 153 moves away from the inner lip 145 of ring 164. Once the friction ring 153 leaves contact with ring 164, the first lid assembly 118 is moved to the open position by the operation of biasing spring 146. The construction and operation of the latch release member 168 will be discussed in greater detail below.

Cap lid 130 also includes a lid hinge member 144, which has a hollow cavity 148 disposed therein. The lid hinge member 144 fits between the first and second ears 150*a* and *b* of the first connection assembly 152. The biasing spring 146 is placed within hollow cavity 148 of the lid hinge member 144. The long end 156 of the biasing spring 146 protrudes out from the hollow cavity 148 and rests against surface 158 on the first ear 150*a*. A lid hinge pin 154 slides through center holes positioned in both the lid hinge member 144 and first and second ears 150*a*, 150*b*, securing the hinge assembly.

In operation, the lid hinge member 144 pivots, relative to the first and second ears 150*a* and *b* and lid hinge pin 154, generally in a direction away from the scope lens 100. The lid hinge member 144 is integrally formed with the first lid assembly 118, thus allowing the entire assembly 118 to move away from the scope lens 100. As can be appreciated, by varying the length of the ears 150, the angular relationship between the first lid assembly 118 in the open position and the sleeve member 162 which is in contact with the scope 100 casing can vary. Also, it has been found that the sleeve member 162 should be made of a soft pliable material, such as a thermoplastic elastomer, so that when the first lid assembly 118, made of a harder material, comes in contact therewith, sound created due to contact of the first lid assembly 118 and sleeve member 162 is, at best, slight. Of particular note, no separate sponge or rubber bumper is required to be attached to the sleeve member 162 for absorption of energy created by operation of biasing spring 156 during the opening operation of the present invention. Thus, no audible click or other noise is heard during the opening operation.

It is also contemplated that sleeve member 162 could have incorporated therein ribs (not shown) to engage first lid assembly 118, such that the ribs act as a controlled shock absorber. Similarly, the rubber-like elastomer material used to create sleeve member 162 tends to have a high coefficient of friction, with a rubber band effect. As a result of these physical material properties, the sleeve member 162 holds the entire cap assembly in place relative to the exterior portions of a scope 100. In contrast, hard durometer plastics will expand and tend to separate from the scope barrel or tube over time, ultimately resulting in unwanted removal of the scope cover from the scope body.

As can be seen in FIG. 4, the first connection assembly 152 includes a lens cap body 160. The lens cap body 160 allows for easy attachment of the lens cap assembly 102 to a firearm scope 100. The lens cap body 160 includes a sleeve member 162, preferably made out of a flexible material, as discussed earlier, for allowing easy positioning of the lens cap assembly 102 about the outer portions of a firearm scope 100. The lens cap body 160 also has a ring member 164, which is made from a material that is generally harder than the material used for creating the sleeve member 162, such as a plastic of about 80/90 durometer. The ring member 164 is disposed outwardly for placement adjacent to an end, either objective or ocular, of the firearm scope 100. Generally, the sleeve member 162 would taper inward as it moves away from the ring member 164 to allow for a variation in optical system barrel sizes with which the invention is to be used, such that it must be stretched in a diameter to fit over the cylindrical end of a scope, and/or the "TV screen" shape of certain lenses, known in the optical device art as "Wide Field" lenses.

In the preferred embodiment, the sleeve member 162 is attached to the ring member 164 by a manufacturing process generally called "over molding." In the preferred embodiment, ring member 164 is molded out of a hard material, in the range of 80/90 durometer, a material which is generally inflexible. Next, ring member 164 is placed in a cavity of an injection mold wherein a second polymer, such as a thermo plastic elastomer, is subsequently injected therein. The second material is injected into the mold in a molten hot fluid state and is allowed to cool under the high pressures of the injection molding machine. After cooling, the ring member 164 becomes an integral part of the sleeve member 162, with each part providing different advantageous properties of strength and flexibility to the overall device. Indeed, it is thought that the over molding process of two similar materials creates a thermally induced molecular bonding of those materials.

In operation, the sleeve member 162 of the lens cap assembly 102 is positioned over either the ocular or objective end of the scope cover 100. By pressing on the lens cap assembly 102, the pliable nature of the sleeve member 162 stretches, allowing the exterior body of the scope 100 to be encompassed thereby. The lens cap assembly 102 is not fully seated on the scope 100 until ring member 164 is in contact with an outer surface of the scope 100. The lens cap assembly 102 remains attached to the scope 100 by the use of friction between the sleeve member 162 and the casing of the scope 100.

Figure 5A:
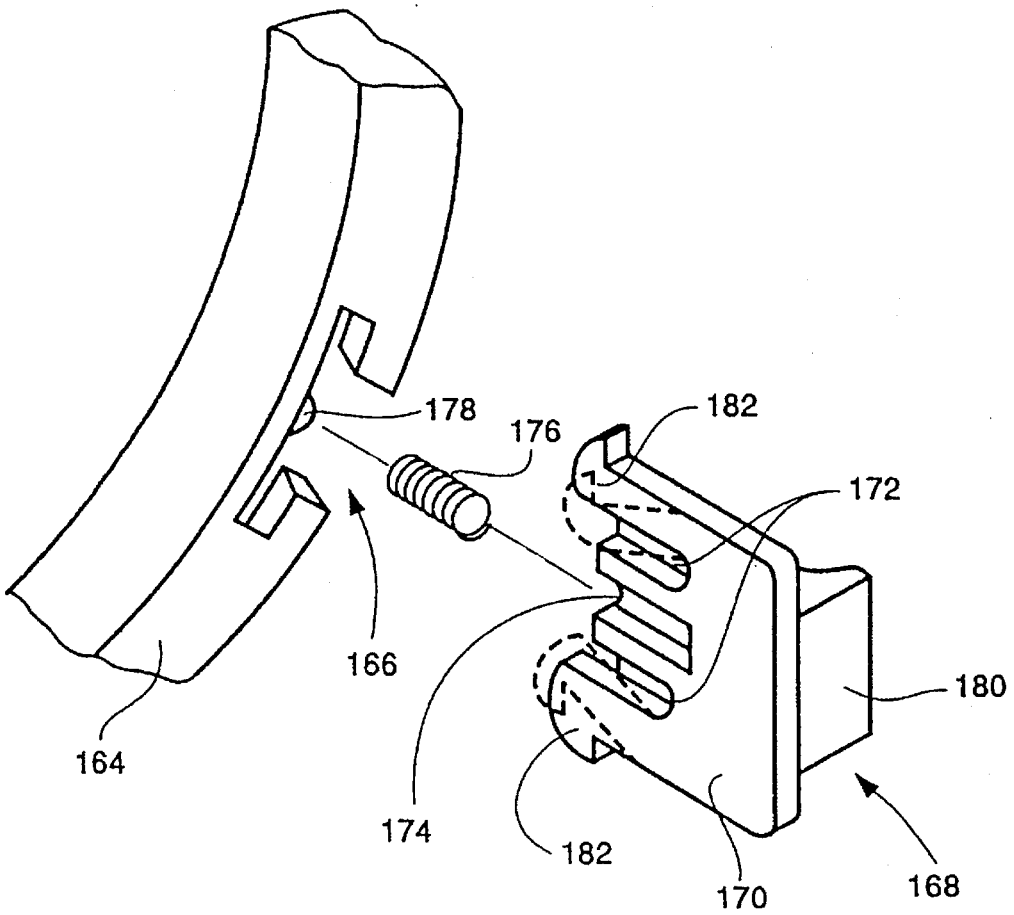
FIG. 5A is an exploded perspective view of the cover release and latch assembly.
Figure 5B:
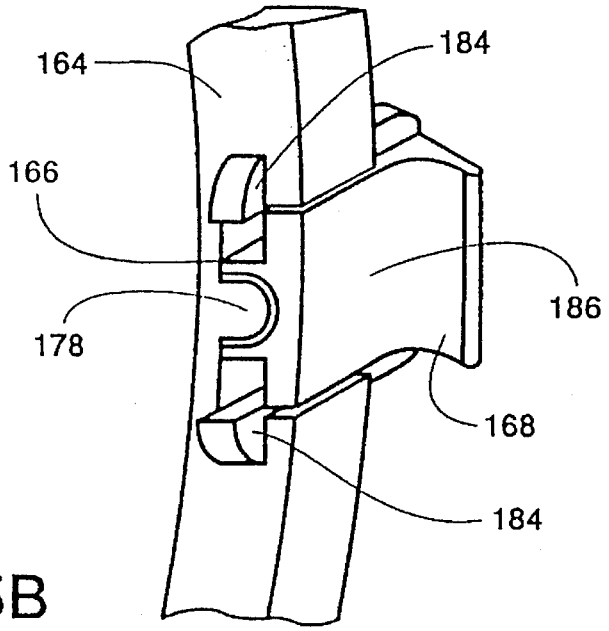
FIG. 5B is a perspective view of the cover release and latch assembly.

First connection assembly 152 also contains a latch release member space 166, which can best be seen in FIGS. 5A–5B. The latch release member space 166 is designed to operatively accept the latch release member 168. As can be seen more clearly in FIG. 5A, the base 170 of the latch release member 168 has two outer 172 and one inner 174 spaces disposed therein. The one inner space 174 retains latch release member biasing spring 176. As can be appreciated, when the latch release member 168 is placed in the latch release member space 166, the latch release member biasing spring 176 comes in contact with biasing spring protrusion 178, causing the rearward end 180 of latch release member 168 to be in a position away from first connection assembly 152.

Retaining the latch release member 168 in the latch release member space 166 are latch release member catches 182. The catches 182 are designed to flex inward, as can be seen in FIG. 5A, into the outer spaces 172 for ease of assembly. The catches 182, upon insertion of the latch release member 168 into the latch release member space 166 expand beyond the sides of the latch connector 168 to engage first connection assembly inner surface 184, as shown in FIG. 5B.

Figure 7B:
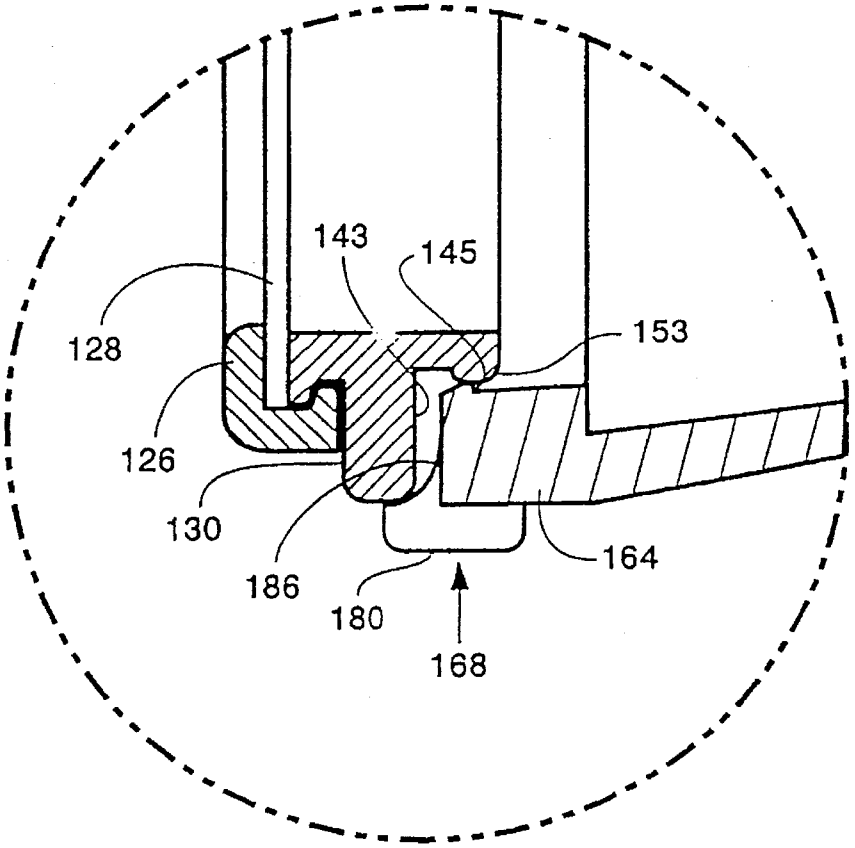
FIG. 7B is a cross section view of the latch release assembly in a partially open position.
Figure 7A:
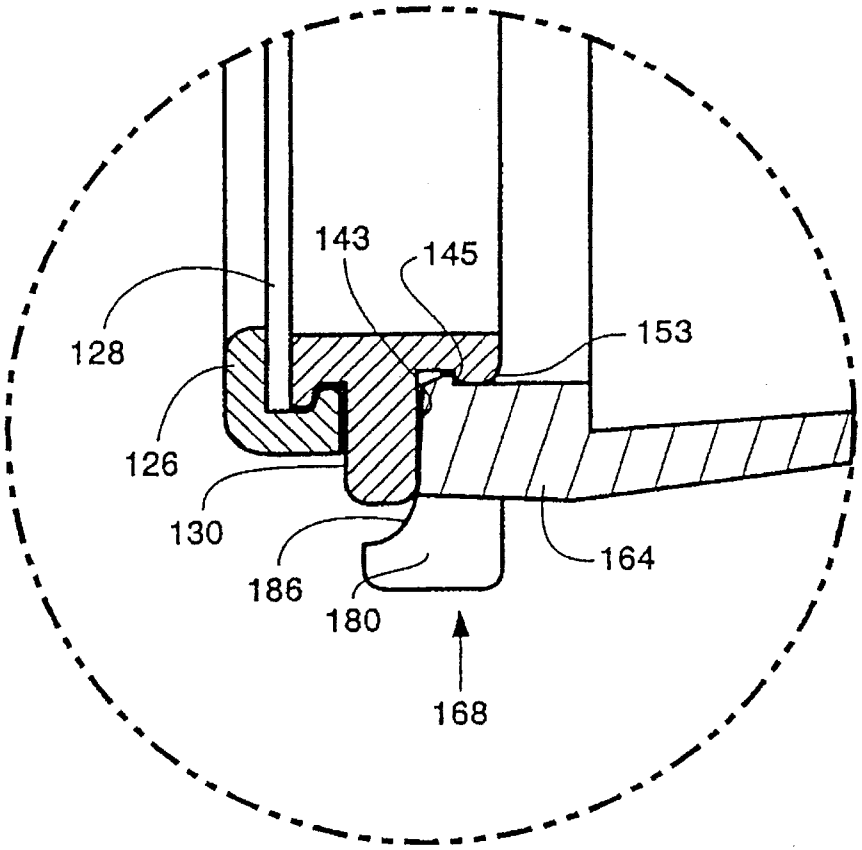
FIG. 7A is a cross section view of the latch release assembly in a fully closed position.

Referring now to FIG. 7A and B, cross sectional views of the latch assembly area provided. In operation, the friction ring 153 integrally formed in first lid assembly 118 is initially forced away from ring member 164 by latch release member 168. Specifically, latch release member 168 is designed in a wedge configuration with the incline or top 186 of the wedge being directly opposite latch release base 170. As latch release member 168 is depressed, it moves in latch release member space 166. While moving, the inclined surface 186 of latch release member 168 contacts the inner surface 143 of the cap lid 130, causing the friction ring 153 to separate from inner lip 145 of ring member 164. One skilled in the art could devise numerous other forms of latch assemblies. It is not feasible here to disclose and discuss all such mechanisms.

In the preferred embodiment, there are also provided two guard ribs 188 which are molded into the exterior circumference of the sleeve member 162 and are made of the same material as sleeve member 162. The guard ribs 188 essentially prevent accidental actuation of the latch release member 168. The guard ribs 188 are positioned about the latch release member 168 such that sufficient room for deliberate actuation of the latch release member 168 by a user's thumbs, even when gloved, is provided. The ribs 188 are designed to deter inadvertent opening of the cap assembly, such as when removing a rifle from a scarab or other similar sliding or bumping actions. It should be appreciated that, in certain applications, only one guard rib would be necessary or desirable.

The foregoing description of the invention has been presented for purposes of illustration and description. Further, the description is not intended to limit the invention to the form disclosed herein. Consequently, variations and modifications commensurate with the above teachings, and the skill or knowledge of the relevant art are within the scope of the present invention. The preferred embodiment described above is further intended to explain the best mode known of practicing the invention and to enable other skilled in the art to utilize the invention in various embodiments and with the various modifications required by their particular applications or use of the invention. It is intended that the appended claims be construed to include all alternative embodiments as permitted by the prior art.

What is claimed is:

1. A method for using polarized lenses with a firearm scope, comprising:

providing a firearm scope having a first scope lens and a second scope lens with a firearm scope body defined therebetween, said second scope lens being located more adjacent to a free end of a barrel of the firearm than said first scope lens;

connecting a first lid assembly having a rotatable first polarized lens with a center to said first scope lens;

mounting a second lid assembly having a rotatable second polarized lens with a center to said second scope lens;

rotating said first polarized lens in a first direction about an axis through said center thereof relative to said second polarized lens while a shooter is viewing through said first polarized lens and said first scope lens wherein cross-polarization is effected in which light, that is allowed to pass through said first and second polarized lenses, changes; and rotating said first polarized lens in a second direction about said axis, opposite said first direction, relative to said first polarized lens while the shooter is viewing through said first polarized lens and said first scope lens wherein cross-polarization is effected in which light, that is allowed to pass through said first and second polarized lenses, changes.

2. A method, as claimed in claim 1, further including:

providing a first latch release member;

providing a second latch release member;

positioning said first latch release member on a first side of said firearm scope;

locating said second latch release member on a second side of said firearm scope, wherein said firearm scope has a central axis through centers of said first and second scope lenses and a vertical plane is defined through said central axis so that said first side is on one side of said vertical plane and said second side is on the opposite side of said vertical plane; and causing movement of said first latch release member by the shooter at the same time the shooter is contacting a trigger of said firearm.

3. A method, as claimed in claim 2, wherein:

said causing step includes having a digit of one of the shooter's hands moving said first latch release member and a digit of the other of the shooter's hands moving said second latch release member at substantially the same time.

4. A lens cap assembly for a firearm scope having at least a first scope lens, comprising:

a first lid assembly including a first lens and having a latch receiving space; and a first connection assembly for connecting said first lid assembly to the firearm scope adjacent to the firearm first scope lens, said first connection assembly including a first latch release member positioned in said latch receiving space and having an inclined surface, wherein said first latch release member has a translational movement in a direction towards the center of the firearm scope first scope lens in order to disengage said first lid assembly from said first connection assembly and in which portions of said first lid assembly contact different portions of said inclined surface that were not contacted previously during said disengagement when said first lid assembly is disengaged from said first connection assembly.

* * * * *